United States Patent [19]

Yonezawa et al.

[11] Patent Number: 4,798,632

[45] Date of Patent: Jan. 17, 1989

[54] NI-BASED ALLOY AND METHOD FOR PREPARING SAME

[75] Inventors: Toshio Yonezawa, Takasago; Noritake Yamaguchi, Kobe; Yasutaka Okada, Amagasaki, all of Japan

[73] Assignee: Mitsubishi Jukogyo Kabushiki Kaisha, Tokyo, Japan

[21] Appl. No.: 4,410

[22] Filed: Jan. 20, 1987

[30] Foreign Application Priority Data

| | | | |
|---|---|---|---|
| Jan. 20, 1986 | [JP] | Japan | 61-9491 |
| Jan. 20, 1986 | [JP] | Japan | 61-9492 |
| Jan. 20, 1986 | [JP] | Japan | 61-9493 |
| Jan. 20, 1986 | [JP] | Japan | 61-9494 |

[51] Int. Cl.[4] ..... C22F 1/10

[52] U.S. Cl. ..... 148/12.7 N; 148/162; 148/410

[58] Field of Search ..... 148/12.7 N, 162, 410, 148/2

[56] References Cited

U.S. PATENT DOCUMENTS 4,652,315 3/1987 Igarashi et al. ..... 148/12.7 N

OTHER PUBLICATIONS

Huntington Alloys, Inc., Copyright 1963 by the International Nickel Company, Inc., Now Huntington Alloys, Inc., 3rd Editional, 1977 "Inconel Alloy X-750".

Huntington, Alloys, Inc. Copyright 1968 by The International Nickel Company, Inc. 2nd Editional, 1973, "Inconel Alloy 718".

Yonezawa, et al, *Effect of Heat Treatment on Street Corrosion Cracking Resistance of High Nickel Alloys in High Temperature Water.*

Hosoi et al, *Proceedings of the International Symposium on Environmental Degradation of Materials in Nuclear Power Systems—Water Reactors,* 1983 "Relation Between Susceptibility to Stress Corrosion Cracking in High Temperature Water and Microstructure of Inconel Alloy X-750".

*Primary Examiner*—R. Dean

*Attorney, Agent, or Firm*—Holman & Stern

[57] ABSTRACT

The present invention is concerned with a high-strength Ni-based alloy excellent in resistance to stress corrosion cracking in high-temperature high-pressure water, characterized by consisting essentially of, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni, having at least one of a $\gamma'$ phase and a $\gamma''$ phase in a $\gamma$ base, and semicontinuously predominantly precipitating $M_{23}C_6$ in grain boundaries; a method for preparing this high-strength Ni-based alloy by heating and maintaining the alloy having the identical composition at 980° to 1,200° C., cooling it, and subjecting it once or more to an aging treatment of additionally heating and maintaining it at 550° to 850° C.; a method for preparing the aforesaid alloy by heating and maintaining the alloy having the identical composition at 980° to 1,200° C., cooling it, subjecting it to a cold working at a 10% or more reduction of area, and subjecting it once or more to an aging treatment of additionally heating and maintaining it at 550° to 850° C.; and a method for preparing the aforesaid alloy by subjecting the alloy having the identical composition to a hot working at 850° to 1,250° C. at a draft percentage of 20% or more, heating and maintaining the alloy at 980° to 1,200° C., cooling it, and subjecting it once or more to an aging treatment of additionally heating and maintaining it at 550° to 850° C.

19 Claims, 9 Drawing Sheets

NI-BASED ALLOY AND METHOD FOR PREPARING SAME

FIELD OF THE INVENTION AND RELATED ART STATEMENT

The present invention relates to an Ni-based alloy which has an excellent resistance to stress corrosion cracking as well as a high strength and which is thus suitable for structural members in light-water reactors or new type nuclear converters, fastening members such as pins, bolts and screws used for fuel elements, spring members such as leaf springs and coiled springs, bolts for turbines, supporting structural members for heat exchangers, and it also relates to a method for preparing such an Ni-based alloy.

Heretofore, as the above mentioned material applicable to the light-water reactor and the like, a precipitated and reinforced Ni-based alloy has often been used which is called Inconel X-750 (trade name) and which is composed of 72% or more of Ni, 14 to 17% of Cr, 6 to 9% of Fe, 1 to 2% of each of Al, Ti and Nb.

However, Inconel X-750 is liable to undergo stress corrosion cracking under given circumstances of the above mentioned applications, depending on conditions for a used heat treatment, and the stress corrosion cracking would occur at times in the above mentioned fastening members and the like made from such a material. In general, the high-strength materials having a great 2% proof strength and tensile strength are considered to be poor in the resistance to stress corrosion cracking. Therefore, no materials have been present anywhere which are desirable as the above mentioned pins, bolts and springs requiring the high strength and the excellent resistance to stress corrosion cracking in high-temperature and high-pressure water.

OBJECT AND SUMMARY OF THE INVENTION

The present invention has been intended in view of the aforesaid disadvantage of the conventional alloy, and its object is to provide an Ni-based alloy which has a high strength and which is additionally excellent in resistance to stress corrosion cracking in high-temperature high-pressure water.

The inventors of the present application have conducted researches intensively, and as a result, it has been found that with regard to the fastening members of the conventional Inconel X-750, a metallic construction varies with chemical composition, conditions for heat treatment, working conditions and the like, with the result that the sensitivity of the material to stress corrosion cracking is disadvantageously heightened. And on the basis of such a knowledge, a novel Ni-based alloy, which has a chemical composition and a metallic construction free from the above mentioned problem, and its manufacturing method have now been developed.

That is, the present invention is directed to a high-strength Ni-based alloy excellent in resistance to stress corrosion cracking in high-temperature high-pressure water which is characterized by containing, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni; having at least one of a $\gamma'$ phase and a $\gamma''$ phase in a $\gamma$ base; and semicontinuously predominantly precipitating $M_{23}C_6$ in a grain boundary, and the present invention is also directed to a method for preparing this high-strength Ni-based alloy.

The aforesaid and other objects, features and benefits of the present invention will be more apparent from the following explanation in reference to accompanying drawings.

Figure 1A:
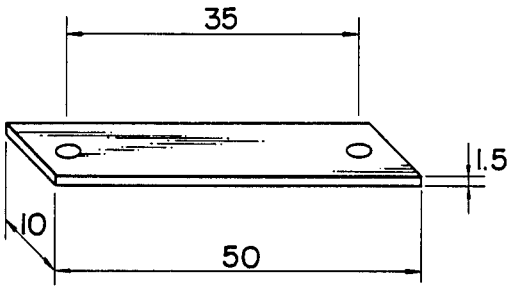
FIGS. 1 (*a*), 1 (*b*) and 1 (*c*) all are explanatory views of test pieces used for tests in examples regarding the present invention.

DETAILED DESCRIPTION OF THE PREFERRED EMBODIMENT (1) The first invention of the present application is connected with a high-strength Ni-based alloy excellent in resistance to stress corrosion cracking in high-temperature high-pressure water which is characterized by consisting essentially of, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni; having at least one of a $\gamma'$ phase and a $\gamma''$ phase in a $\gamma$ base; and semicontinuously predominantly precipitating $M_{23}C_6$ in grain boundaries.

A dependent invention of this first invention is connected with a high-strength Ni-based alloy in which 10% or less of Mo is additionally contained in the alloy regarding the first invention.

Another dependent invention of the first invention is connected with a high-strength Ni-based alloy in which 0.1% or less of at least one of a rare earth element, Mg and Ca is contained in the alloy regarding the first invention.

Still another dependent invention of the first invention is connected with a high-strength Ni-based alloy in which 10% or less of Mo and 0.1% or less of at least one of a rare earth element, Mg and Ca are contained in the alloy regarding the first invention.

Further, the second to fourth inventions of the present application which are the following inventions (2) to (4) are each directed to a method for preparing the aforesaid Ni-based alloy.

(2) The second invention of the present application is connected with a method for preparing a high-strength Ni-based alloy excellent in resistance to stress corrosion cracking in high-temperature high-pressure water which is principally characterized by heating and maintaining, at 980 to 1,200° C., the alloy consisting essentially of, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni; cooling the alloy at a cooling rate of an air cooling or more; and subjecting the alloy once or more to an aging treatment of additionally heating and maintaining it at 550° to 850° C.

A dependent invention of this second invention is connected with a method for preparing a high-strength Ni-based alloy in which the alloy to be treated additionally contains 10% or less of Mo.

Another dependent invention of the second invention is connected with a method for preparing a high-strength Ni-based alloy in which the alloy to be treated additionally contains 0.1% or less of at least one of a rare earth element, Mg and Ca.

Still another dependent invention of the second invention is connected with a method for preparing a high-strength Ni-based alloy in which the alloy to be treated additionally contains 10% or less of Mo and 0.1% or less of at least one of a rare earth element, Mg and Ca.

(3) The third invention of the present application is connected with a method for preparing a high-strength Ni-based alloy excellent in resistance to stress corrosion cracking in high-temperature high-pressure water which is principally characterized by heating and maintaining, at 980 to 1,200° C., the alloy consisting essentially of, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni; cooling the alloy at a cooling rate of an air cooling or more; subjecting the alloy to a cold working at a 10% or more reduction of area; and subjecting the alloy once or more to an aging treatment of additionally heating and maintaining it at 550° to 850° C.

A dependent invention of this third invention is connected with a method for preparing a high-strength Ni-based alloy in which the alloy to be treated additionally contains 10% or less of Mo.

Another dependent invention of the third invention is connected with a method for preparing a high-strength Ni-based alloy in which the alloy to be treated additionally contains 0.1% or less of at least one of a rare earth element, Mg and Ca.

Still another dependent invention of the third invention is connected with a method for preparing a high-strength Ni-based alloy in which the alloy to be treated additionally contains 10% or less of Mo and 0.1% or less of at least one of a rare earth element, Mg and Ca.

(4) The fourth invention of the present application is connected with a method for preparing a high-strength Ni-based alloy excellent in resistance to stress corrosion cracking in high-temperature high-pressure water which is principally characterized by subjecting, to a hot working at 850 to 1,250° C. at a draft percentage of 20% or more, the alloy consisting essentially of, in terms of weight ratio, 0.08% or less of C, 0.15% or less of Si, 0.1 to 1% of Mn, 15% or less of Fe, 20 to 30% of Cr, 3.5% or less of Ti, 2% or less of Al, 7% or less of Nb and the balance of Ni; heating and maintaining the alloy at 980 to 1,200° C.; cooling the alloy at a cooling rate of an air cooling or more; and subjecting the alloy once or more to an aging treatment of additionally heating and maintaining it at 550° to 850° C.

A dependent invention of this fourth invention is connected with a method for preparing a high-strength Ni-based alloy in which the alloy to be treated additionally contains 10% or less of Mo.

Another dependent invention of the fourth invention is connected with a method for preparing a high-strength Ni-based alloy in which the alloy to be treated additionally contains 0.1% or less of at least one of a rare earth element, Mg and Ca.

Still another dependent invention of the fourth invention is connected with a method for preparing a high-strength Ni-based alloy in which the alloy to be treated additionally contains 10% or less of Mo and 0.1% or less of at least one of a rare earth element, Mg and Ca.

Now, reference will be made to reasons for restriction on amount values of the respective components in the aforesaid inventions.

C: C is bound to Cr in order to form the Cr carbide of $M_{23}C_6$ in grain boundaries and to thereby heighten a binding power of crystal grains therein. However, when an amount of C is in excess of 0.08%, C will be bound to Nb and Ti in order to form NbC and TiC, and $\gamma'$ and $\gamma''$ phases which will be formed by binding Nb and Ti to Ni will be decreased, with the result that the strength of a produced alloy will decline. In consequence, the content of C therein is set to 0.08% or less.

Si: Si has the function of removing oxygen, which is an impurity, from the alloy, but when its content is more than 0.15%, the semicontinuous precipitation of $M_{23}C_6$ will be prevented in grain boundaries, and in consequence, the stress corrosion cracking resistance of the produced alloy will decline. Accordingly, the content of Si is set to 0.15% or less.

Mn: Mn is an element for accelerating the semicontinuous precipitation of $M_{23}C_6$ in grain boundaries, and it is necessary that its content is 0.1% or more. However, when it is in excess of 1%, a brittle phase for impairing the ductility of the produced alloy will be precipitated superiorly. Therefore, the content of Mn is set to the range of 0.1 to 1%.

Fe: Fe is an element of heightening the stability of an alloy construction at the time of casting or plastic working, but when its content exceeds a level of 15%, the ductility of the produced alloy will be hurt. For this reason, the content of Fe is set to 15% or less.

Cr: Cr is the most important element to retain the resistance to stress corrosion cracking, and its content is required to be 20% or more. However, when the content of Cr is more than 30%, solidification and segregation will occur remarkably and thus forging will be difficult to do. In addition, a uniform ingot will be hard to produce. Therefore, the content of Cr is set to the range of 20 to 30%.

Mo: Mo improves the resistance to pitting corrosion and the resistance to gap corrosion, but when its amount is in excess of 10%, the precipitation of $M_{23}C_6$ will be inhibited in grain boundaries and the resistance to stress corrosion cracking will decline. Accordingly, the content of Mo is set to 10% or less.

Ti: Ti is bound to Ni in order to precipitate $\gamma'$ of $Ni_3Ti$ and to thereby build up the strength of the product. When a content of Ti is more than 3.5%, its ductility will be poor, and a $\eta$ phase will precipitate, which fact will lead to the deterioration in the resistance to stress corrosion cracking. For this reason, the content of Ti is set to 3.5% or less.

Al: Al is bound to Ni in order to precipitate $\gamma'$ of $Ni_3Al$ and to thereby heighten the strength of the product, but when its content exceeds a level of 2%, the resistance to stress corrosion cracking will deteriorate. Therefore, the content of Al is set to 2% or less.

Nb: Nb is bound to Ni in order to precipitate a $\gamma''$ phase of $Ni_3Nb$ or a $\delta$ phase and to thereby heighten the strength of the alloy product, but when its content is in excess of 7%, the resistance to stress corrosion cracking will decline. In consequence, the content of Nb is set to 7% or less.

Rare earth element, Mg and Ca: A rare earth element such as Hf or Y, Mg and Ca not only remove oxygen, which is an impurity, from the alloy but also enhance the binding power of grain boundaries. However, when each content thereof is in excess of 0.1%, the resistance to stress corrosion cracking will be poor. Therefore, the content of at least one of the rare earth element, Mg and Ca is set to 0.1% or less.

As conditions for the heat treatment, there are required the solid solution treatment and the subsequent aging treatment so as to keep up the high strength and the high resistance to stress corrosion cracking of the alloy, the aforesaid solid solution treatment comprising the steps of heating and maintaining the alloy at 980° to 1,200° C., and then cooling the alloy at a cooling rate of an air cooling or more, the aforesaid aging treatment comprising the step of additionally heating and maintaining the alloy at 550° to 850° C., and being necessarily carried out once or more.

In this connection, the heat treatment is preferably carried out for a period of 5 minutes to 5 hours in the solid solution treatment and further for 1 to 150 hours in the aging treatment.

Generally, in the case of a material for casting, the above mentioned solid solution treatment and aging treatment alone are enough, but when a cold working and a hot working are additionally performed, the following conditions may be employed for the working operations.

That is, the cold working, after the solid solution treatment, may be carried out uniformly at a high working ratio of 10% or more reduction of area in order to procure the excellent resistance to stress corrosion cracking.

According to the aforesaid cold working conditions, there can be prepared the high-strength material having not only the excellent resistance to stress corrosion cracking but also a 0.2% proof strength of 90 kg/mm$^2$ or more and a tensile strength of 100 kg/mm$^2$.

Further, the above mentioned hot working may be carried out uniformly at a working temperature of 850° to 1,250° C. so as to prevent the cracking and an excessive grain growth, and at a draft percentage of 20% or more so as to retain the excellent resistance to stress corrosion cracking.

According to the above hot working conditions, there can be prepared the high-strength material having not only the excellent resistance to stress corrosion cracking but also a 0.2% proof strength of 70 kg/mm$^2$ or more at room temperature and a tensile strength of 90 kg/mm$^2$.

Next, reference will be made to tests of stress corrosion cracking. These tests were carried out by the following procedure.

(1) Tests of stress corrosion cracking

Figure 1B:
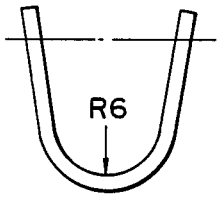
Figure 1C:
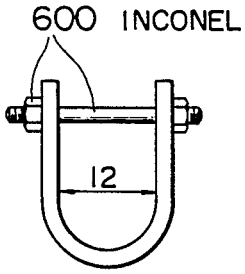

For the purpose of evaluating, under circumstances in a light-water reactor, the stress corrosion cracking resistance of fastening members, bellows and the like in which the Ni-based alloy of the present invention was employed, tests of stress corrosion cracking were carried out by immersing U-bent test pieces shown in FIG. 1 into water having conditions in Table 1 which simulated a primary system water in a pressurized water type light-water reactor; then applying a high stress thereto for 4,000 hours; and afterward checking cracks in the test pieces.

(2) Test pieces

Chemical composition of the test pieces used in the tests is set forth in Table 2, and conditions for the heat treatments and the workings of the test pieces are exemplarily set forth in Tables 3-1 and 3-2.

In the test pieces, elements of P and S were each contained in an amount of at most 0.01% or so, Cu in an amount of at most 0.07% or so, and N in an amount of at most 0.01% or so, as impurities.

(3) Results of tests

The results of the tests are set forth in Tables 3-1 and 3-2 and FIGS. 2 to 10. As elucidated in Table 4, white and black symbols in the accompanying drawings indicate "not cracked" and "cracked", respectively, in the test pieces.

With regard to each test piece in which no cracks occurred, its metallic construction was observed. The results made it apparent that a $\gamma'$ phase or a $\gamma''$ phase was dispersed in a $\gamma$ base and that $M_{23}C_6$ was semicontinuously and predominantly precipitated in grain boundaries. Typical examples of such test pieces are set forth in Table 5.

Figure 2A:
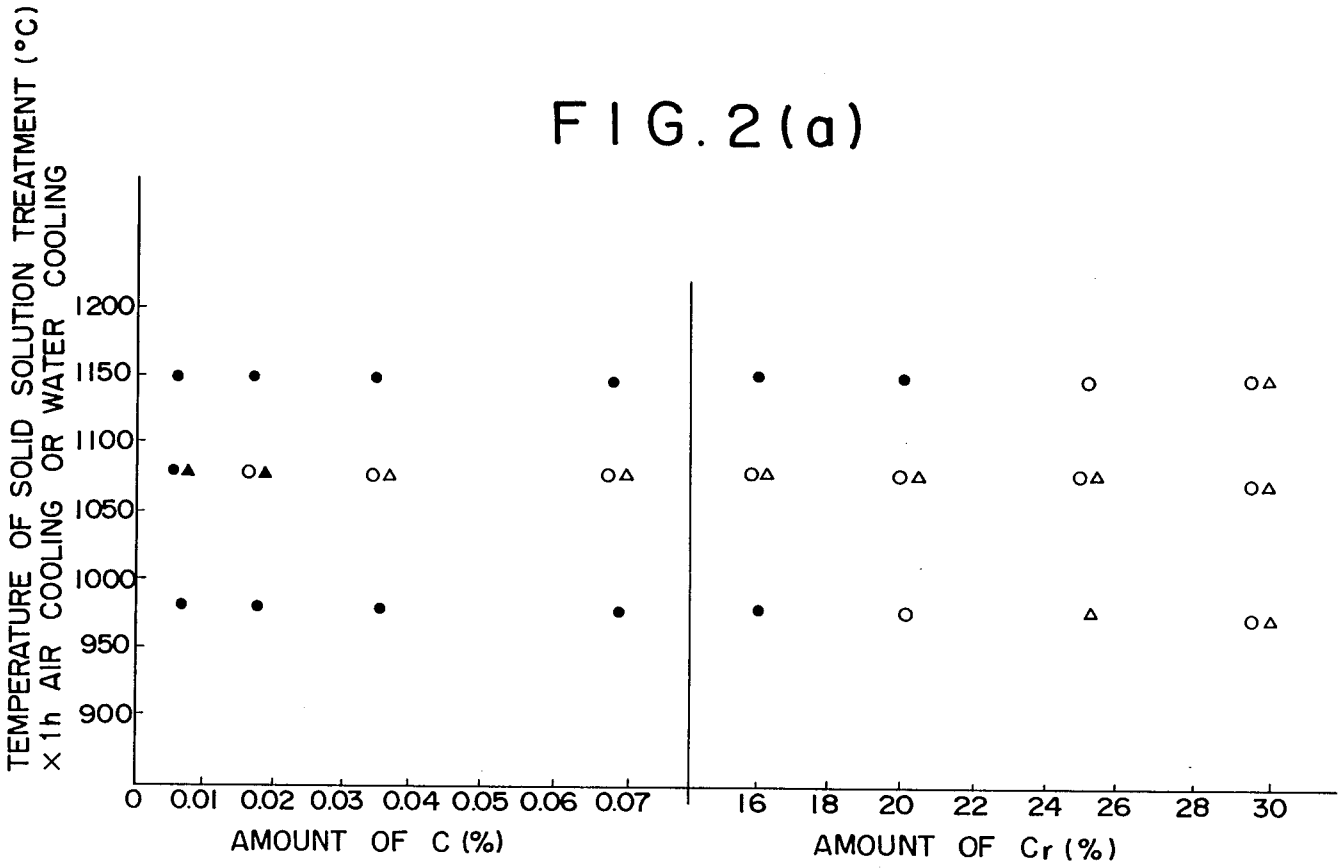
FIGS. 2 (*a*) and 2 (*b*) both are graphs showing relations of heat treatment conditions to each amount of C and Cr.
Figure 2B:
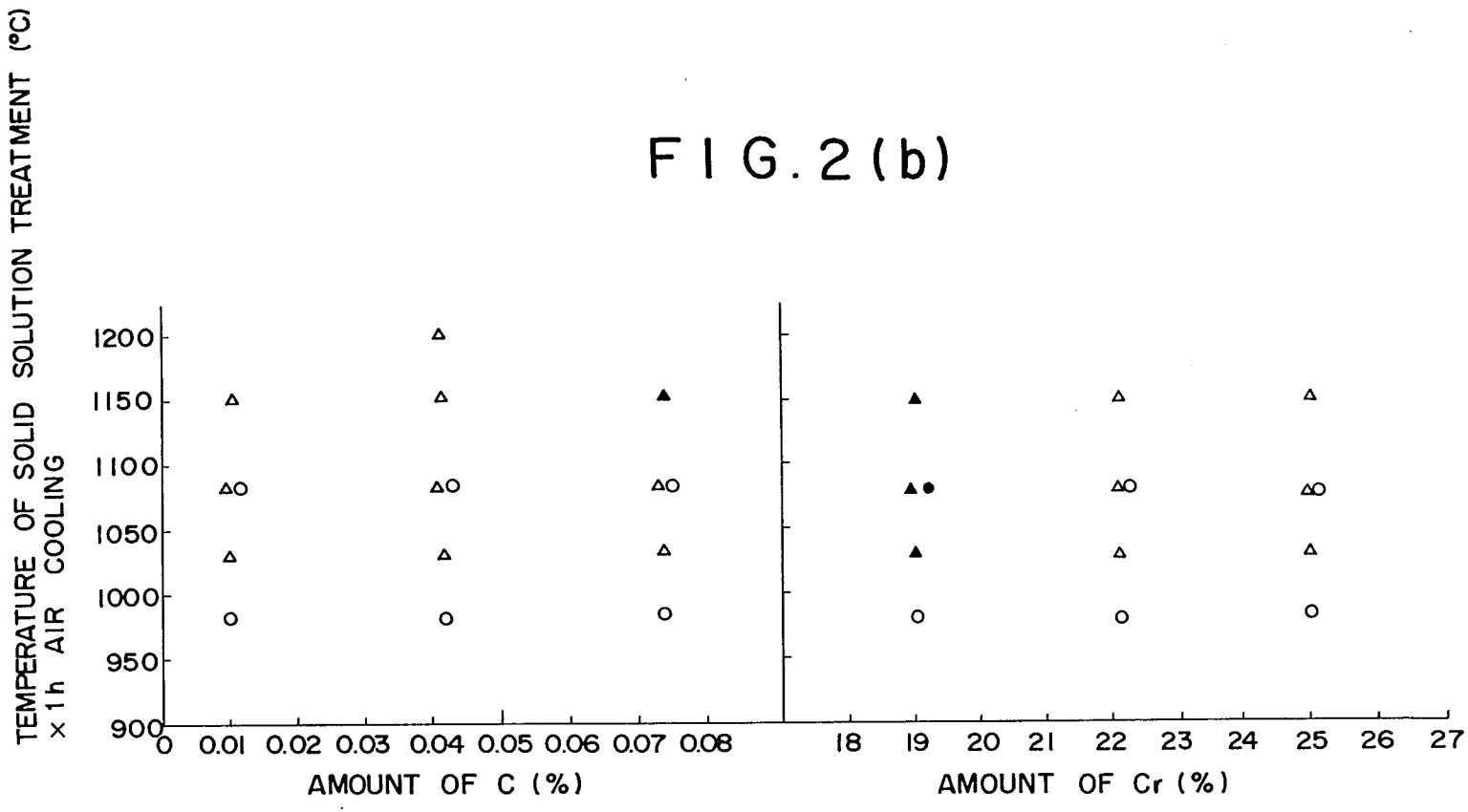
Figure 3:
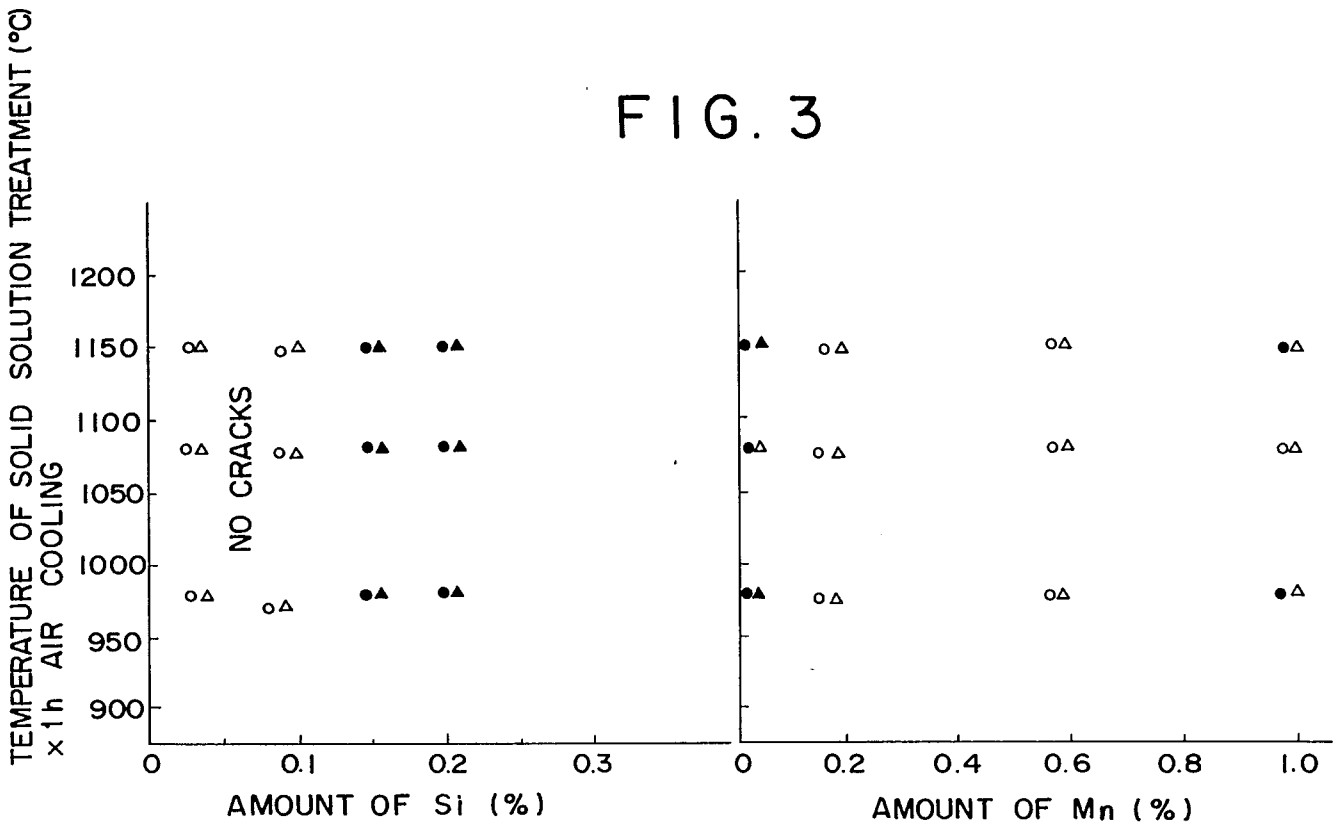
FIG. 3 is a similar graph showing a relation of heat treatment conditions to each amount of Si and Mn.
Figure 4:
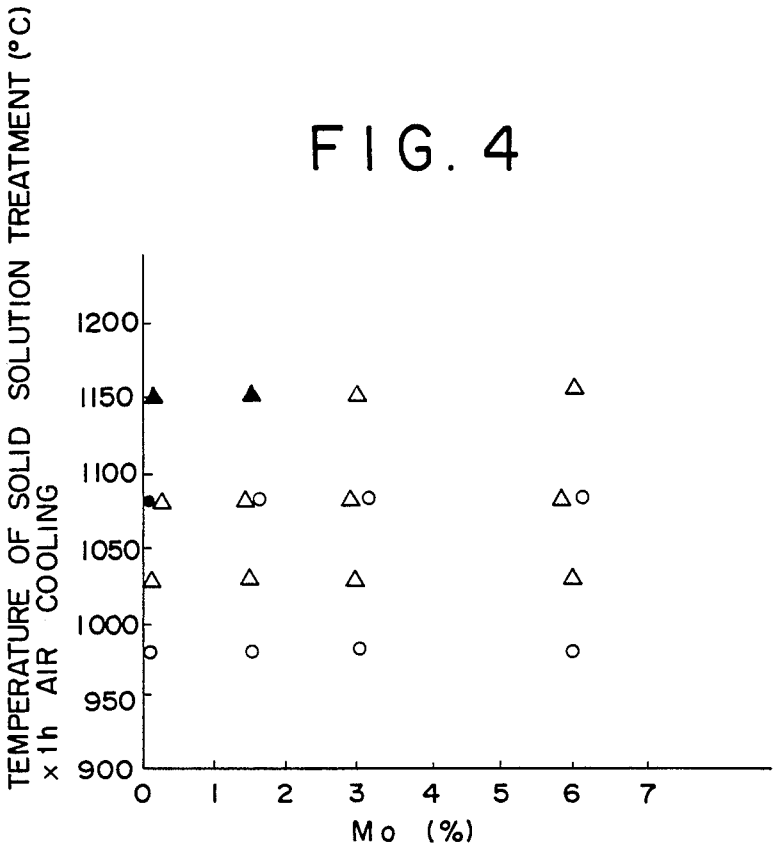
FIG. 4 is a similar graph showing a relation between heat treatment conditions and an amount of Mo.

The crack occurrences due to the influence of the respective components and heat treatment conditions are exhibited in FIGS. 2 (*a*) and 2 (*b*) as well as FIGS. 3, 4 and Table 6, and it can be grasped that the test pieces in the range of the compositions and the heat treatment conditions of the present invention were more excellent in resistance to stress corrosion cracking than the other test pieces.

Figure 5A:
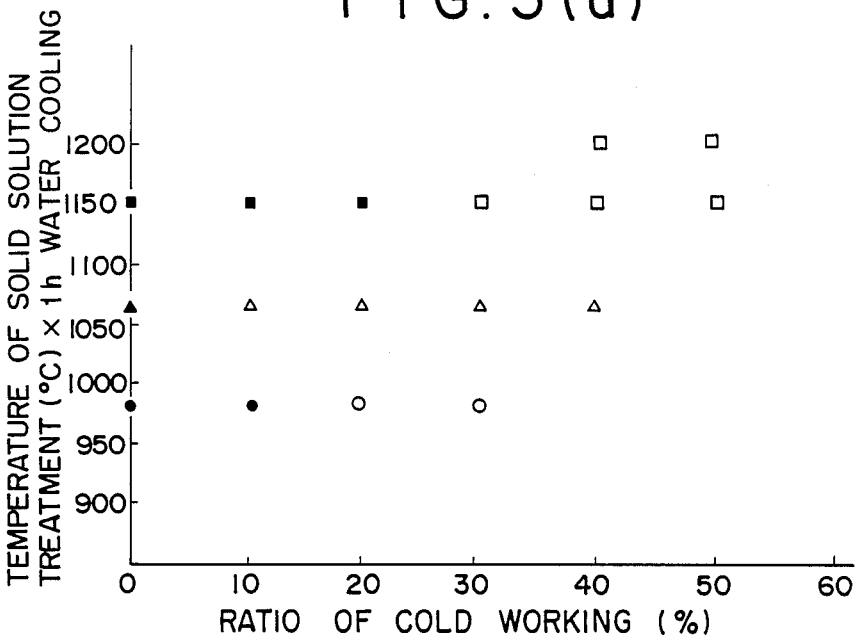
FIGS. 5 (*a*) and 5 (*b*) are graphs showing relations between heat treatment conditions and a cold working ratio.
Figure 5B:
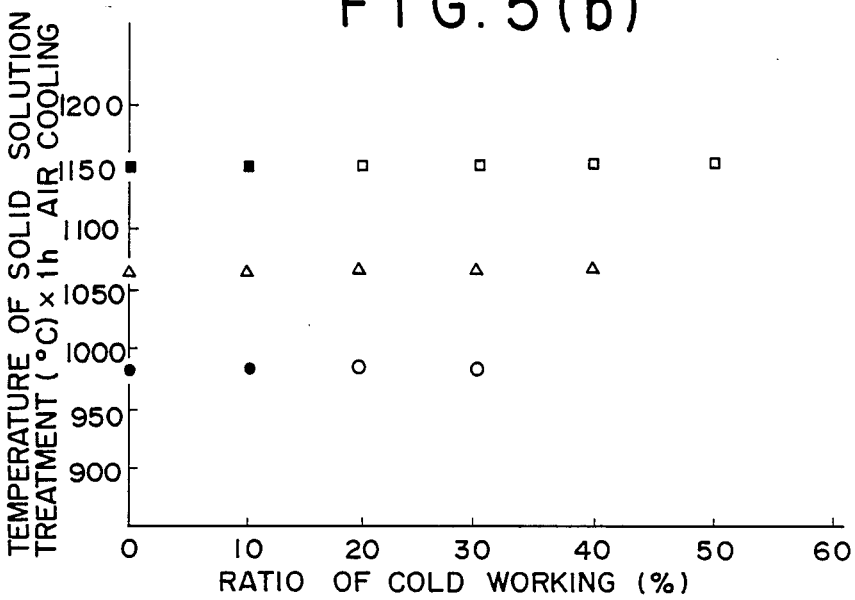

Further, FIGS. 5 (*a*) and 5 (*b*) show relations of the crack occurrences to ratios of the cold working and temperatures of the solid solution treatment, and it is indicated thereby that all the test pieces in the range of the conditions regarding the present invention were more excellent in resistance to stress corrosion cracking than the other ones.

Figure 6:
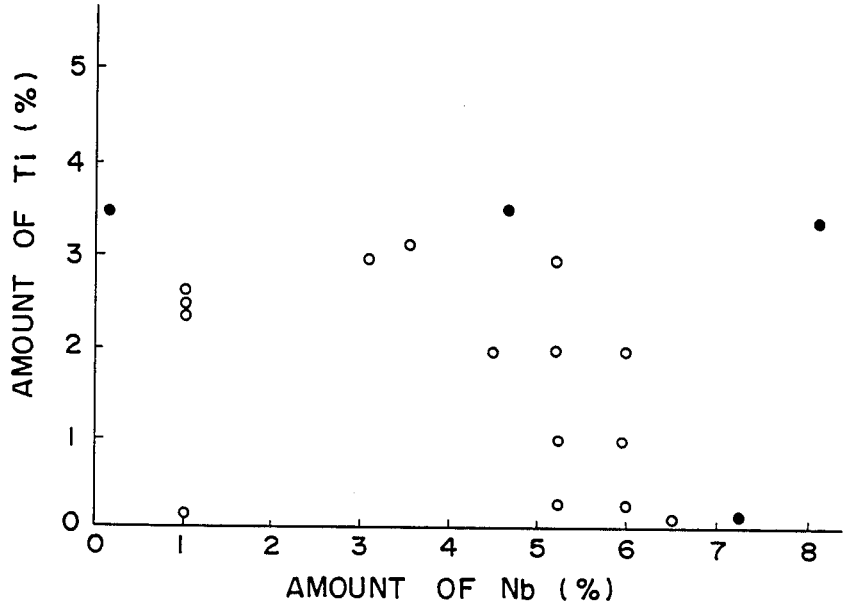
FIG. 6 is a graph showing a relation between amounts of Ti and Nb.
Figure 7:
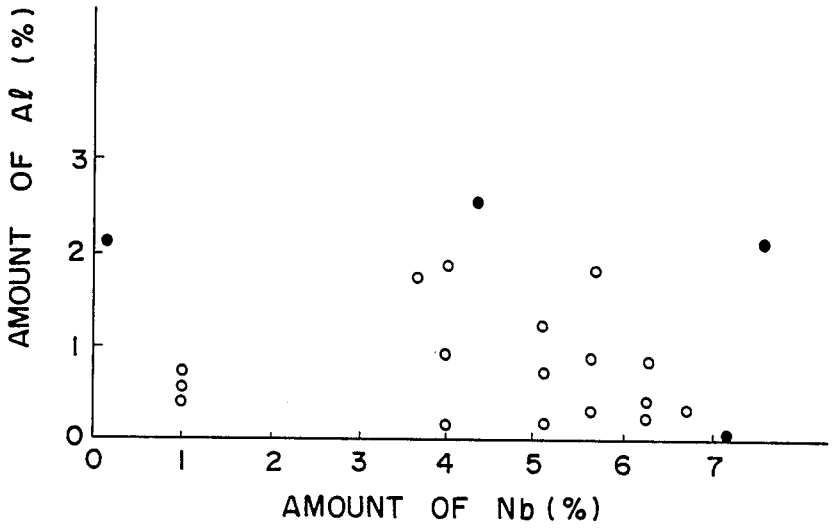
FIG. 7 is a graph showing a relation between amounts of Al and Nb.

FIGS. 6 and 7 show the influences of amounts of Ti and Al on the stress corrosion cracking resistance, and it is definite that all the test pieces in the range of the conditions regarding the present invention were more excellent in resistance to stress corrosion cracking than the other ones.

Figure 8:
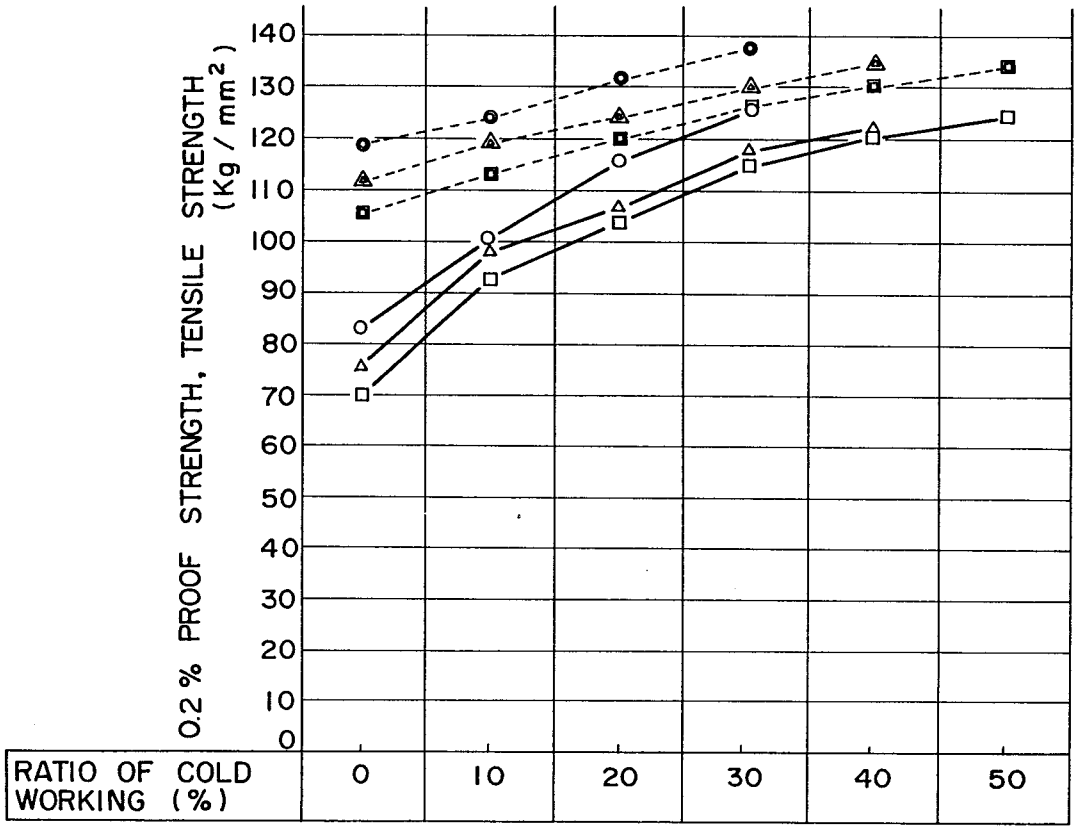
FIG. 8 is a graph showing relations of a cold working ratio to a tensile strength and a 0.2% proof strength.

In FIG. 8, there are shown relations between mechanical properties and ratios of the cold working, and all the test pieces in the range of the present invention were excellent in resistance to stress corrosion cracking and additionally in a 0.2% proof strength and a tensile strength, as shown in FIGS. 5 (*a*) and 5 (*b*).

Figure 9:
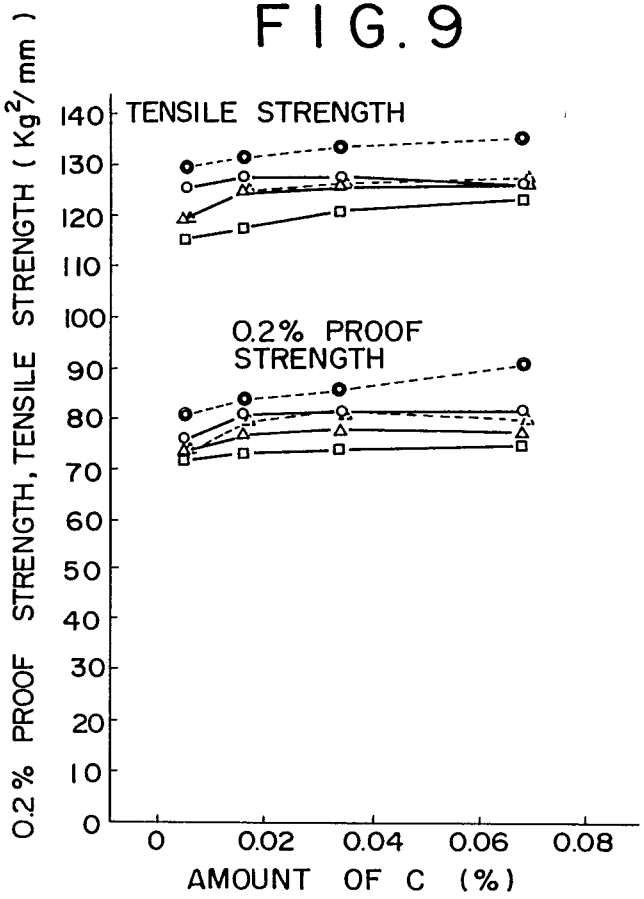
FIGS. 9 and 10 show relations of a tensile strength and a 0.2% proof strength to amounts of C and Cr, respectively.
Figure 10:
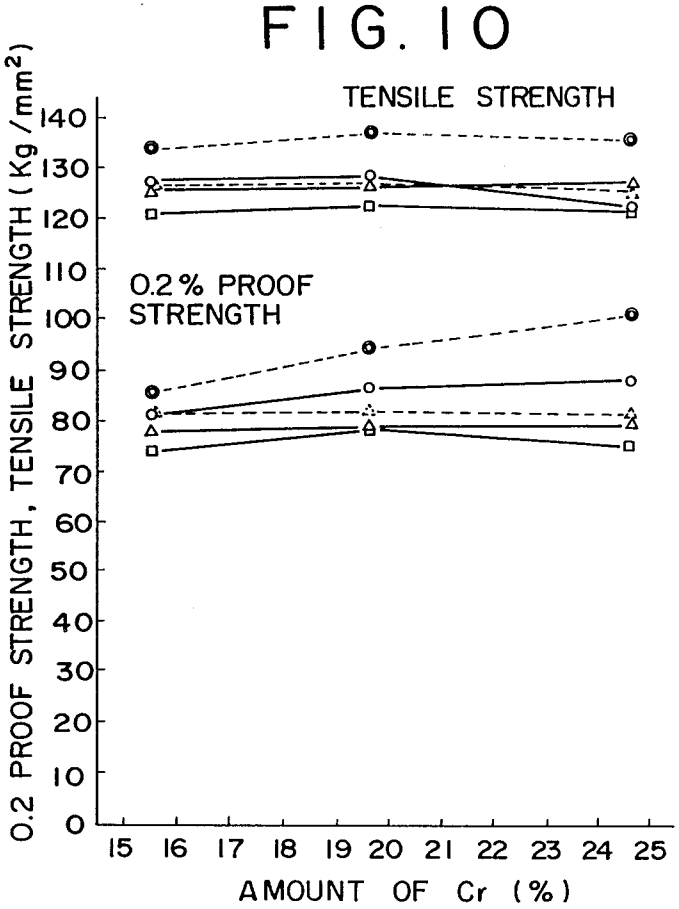

FIGS. 9 and 10 exhibit relations between chemical components and mechanical properties of the alloys which were subjected to the hot working at a 30% draft, and the test pieces in the range of the present invention were excellent in stress corrosion cracking resistance and additionally in mechanical properties.

With regard to the respective drawings (except FIG. 1) having the subsections (a) an (b), as in FIGS. 2 (a) and 2 (b), data are divided into the drawings of (a) and (b) by presence or absence of the Mo element. The drawing to which "(a)" is attached is concerned with the test pieces containing no Mo, and the drawing with "(b)" is about the test pieces containing Mo.

TABLE 1

| | |
|---|---|
| (1) Temperature | 360° C. |
| (2) Pressure | 214 kg/cm$^2$G |

TABLE 1-continued

| | |
|---|---|
| (3) Properties of Water | |
| pH (at 25° C.) | about 7 |
| Conc. of $H_3BO_3$ (as B) | about 500 ppm |
| Conc. of LiOH (as Li) | about 2 ppm |
| $H_2$ | about 30 cc · STP/kg · $H_2O$ |
| $DO_2$ | <5 ppb |
| $Cl^-$ | <0.1 ppm |

TABLE 2

Chemical composition of test piece

| Test Piece (Alloy) | Chemical Composition (%) | | | | | | | | | | | | | |
|---|---|---|---|---|---|---|---|---|---|---|---|---|---|---|
| | C | Si | Mn | Ni | Cr | Mo | Fe | Ti | Al | Nb | Hf | Y | Mg | Ca |
| 1 | 0.004 | 0.036 | <0.01 | 72.8 | 15.73 | <0.05 | 7.21 | 2.57 | 0.68 | 0.92 | — | — | — | — |
| 2 | 0.019 | 0.032 | <0.01 | 72.8 | 15.81 | <0.05 | 7.06 | 2.58 | 0.70 | 1.00 | — | — | — | — |
| 3 | 0.036 | 0.033 | <0.01 | 72.9 | 15.72 | <0.05 | 7.03 | 2.63 | 0.70 | 0.98 | — | — | — | — |
| 4 | 0.075 | 0.033 | <0.01 | 73.5 | 15.20 | <0.05 | 6.86 | 2.63 | 0.71 | 0.96 | — | — | — | — |
| 5 | 0.040 | 0.15 | <0.01 | 72.8 | 15.70 | <0.05 | 7.08 | 2.60 | 0.69 | 1.00 | — | — | — | — |
| 6 | 0.039 | 0.20 | 0.99 | 71.7 | 15.81 | <0.05 | 6.96 | 2.59 | 0.70 | 0.99 | — | — | — | — |
| 7 | 0.041 | 0.21 | 0.58 | 71.6 | 15.90 | <0.05 | 6.98 | 2.61 | 0.71 | 1.01 | — | — | — | — |
| 8 | 0.043 | 0.030 | <0.01 | 69.0 | 19.70 | <0.05 | 6.89 | 2.61 | 0.71 | 0.97 | — | — | — | — |
| 9 | 0.032 | 0.031 | <0.01 | 64.1 | 24.61 | <0.05 | 6.94 | 2.62 | 0.71 | 0.92 | — | — | — | — |
| 10 | 0.042 | 0.029 | <0.01 | 59.2 | 29.50 | <0.05 | 6.88 | 2.61 | 0.70 | 0.96 | — | — | — | — |
| 11 | 0.040 | 0.030 | <0.01 | 72.6 | 15.89 | 0.96 | 7.12 | 2.65 | 0.68 | 0.98 | — | — | — | — |
| 12 | 0.036 | 0.010 | <0.01 | 73.9 | 15.72 | <0.05 | 6.71 | 3.54 | 0.061 | 0.002 | — | — | — | — |
| 13 | 0.038 | 0.014 | <0.01 | 76.0 | 15.73 | <0.05 | 6.10 | <0.001 | 2.05 | 0.002 | — | — | — | — |
| 14 | 0.032 | 0.010 | <0.01 | 70.5 | 15.58 | <0.05 | 6.92 | 0.025 | 0.096 | 7.05 | — | — | — | |
| 15 | 0.039 | 0.032 | <0.01 | 63.0 | 25.55 | <0.05 | 7.01 | 2.54 | 0.73 | 0.96 | — | — | 0.0500 | — |
| 16 | 0.040 | 0.031 | <0.01 | 63.0 | 25.50 | <0.05 | 7.06 | 2.63 | 0.68 | 1.01 | — | 0.070 | — | — |
| 17 | 0.041 | 0.025 | <0.01 | 62.9 | 25.60 | <0.05 | 7.05 | 2.60 | 0.72 | 0.99 | 0.065 | — | — | — |
| 18 | 0.041 | 0.030 | <0.01 | 62.8 | 25.80 | <0.05 | 6.97 | 2.56 | 0.67 | 1.02 | 0.032 | 0.041 | — | — |
| 19 | 0.040 | 0.031 | 0.98 | 62.0 | 25.55 | 0.30 | 6.80 | 2.60 | 0.71 | 1.01 | — | — | — | — |
| 20 | 0.041 | 0.030 | <0.01 | 63.1 | 25.65 | <0.05 | 6.95 | 2.54 | 0.67 | 1.00 | — | — | — | 0.001 |

| Test Piece (Alloy) | Chemical Composition (%) | | | | | | | | | | | | | | |
|---|---|---|---|---|---|---|---|---|---|---|---|---|---|---|---|
| | C | Si | Mn | P | S | Ni | Cr | Mo | Fe | Ti | Al | Nb | Hf | Y | Mg |
| 21 | 0.011 | 0.13 | 0.05 | 0.003 | 0.002 | 51.89 | 22.18 | 2.93 | 16.3 | 0.12 | 0.33 | 5.90 | — | — | — |
| 22 | 0.049 | 0.13 | 0.05 | 0.002 | 0.002 | 51.92 | 22.20 | 2.94 | 16.2 | 0.12 | 0.34 | 5.93 | — | — | — |
| 23 | 0.075 | 0.13 | 0.05 | 0.002 | 0.003 | 52.02 | 22.34 | 2.92 | 16.1 | 0.11 | 0.35 | 5.81 | — | — | — |
| 24 | 0.045 | 0.14 | 0.05 | 0.002 | 0.002 | 52.21 | 19.32 | 2.97 | 18.7 | 0.12 | 0.36 | 6.01 | — | — | — |
| 25 | 0.043 | 0.13 | 0.03 | 0.003 | 0.002 | 51.93 | 25.30 | 2.95 | 13.0 | 0.12 | 0.32 | 6.02 | — | — | — |
| 26 | 0.040 | 0.14 | 0.03 | 0.006 | 0.002 | 52.15 | 22.48 | 0.03 | 18.6 | 0.12 | 0.35 | 5.93 | — | — | — |
| 27 | 0.040 | 0.13 | 0.03 | 0.003 | 0.002 | 52.56 | 22.59 | 1.49 | 16.6 | 0.11 | 0.33 | 5.98 | — | — | — |
| 28 | 0.039 | 0.12 | 0.03 | 0.003 | 0.002 | 51.94 | 22.43 | 2.93 | 15.7 | 1.00 | 0.63 | 5.11 | — | — | — |
| 29 | 0.041 | 0.13 | 0.03 | 0.002 | 0.003 | 52.07 | 22.40 | 2.94 | 15.3 | 0.12 | 0.83 | 6.04 | — | — | — |
| 30 | 0.012 | 0.24 | 0.06 | 0.005 | 0.004 | 50.68 | 20.34 | 3.37 | 20.8 | 0.13 | 0.20 | 3.48 | — | — | — |
| 31 | 0.013 | 0.24 | 0.63 | 0.003 | 0.004 | 50.18 | 20.11 | 6.07 | 18.9 | 0.12 | 0.18 | 3.44 | — | — | — |
| 32 | 0.010 | 0.24 | 0.65 | 0.003 | 0.003 | 60.19 | 20.23 | 3.34 | 11.4 | 0.13 | 0.20 | 3.47 | — | — | — |
| 33 | 0.012 | 0.24 | 0.66 | 0.003 | 0.005 | 51.08 | 25.42 | 3.36 | 15.2 | 0.14 | 0.20 | 3.53 | — | — | — |
| 34 | 0.012 | 0.24 | 0.66 | 0.005 | 0.004 | 50.23 | 25.09 | 6.01 | 13.8 | 0.13 | 0.20 | 3.47 | — | — | — |
| 35 | 0.012 | 0.24 | 0.66 | 0.004 | 0.004 | 60.46 | 25.34 | 3.34 | 6.0 | 0.12 | 0.20 | 3.50 | — | — | — |
| 36 | 0.0056 | 0.25 | 0.62 | 0.010 | 0.003 | 49.97 | 19.89 | 2.27 | 23.1 | 2.63 | 0.14 | <0.01 | — | — | — |
| 37 | 0.0052 | 0.26 | 0.62 | 0.009 | 0.002 | 50.89 | 20.14 | 5.89 | 19.2 | 2.70 | 0.14 | <0.01 | — | — | — |
| 38 | 0.0051 | 0.27 | 0.63 | 0.007 | 0.003 | 50.17 | 24.87 | 3.33 | 17.8 | 2.69 | 0.15 | <0.01 | — | — | — |
| 39 | 0.011 | 0.27 | 0.63 | 0.010 | 0.003 | 50.86 | 25.21 | 6.02 | 14.0 | 2.72 | 0.14 | <0.01 | — | — | — |
| 40 | 0.016 | 0.11 | 0.34 | 0.005 | 0.003 | 52.02 | 25.51 | 3.50 | 13.6 | 0.10 | 0.27 | 4.42 | — | — | — |
| 41 | 0.036 | 0.01 | 0.01 | 0.001 | 0.001 | 64.75 | 25.13 | 0.01 | 5.9 | 2.47 | 0.63 | 0.98 | — | — | — |
| 42 | 0.039 | 0.01 | 0.61 | 0.001 | 0.001 | 66.11 | 23.67 | 0.04 | 5.1 | 2.60 | 0.74 | 1.01 | — | — | — |
| 43 | 0.040 | 0.32 | 0.62 | 0.001 | 0.002 | 66.31 | 23.87 | 0.03 | 4.5 | 2.60 | 0.64 | 1.00 | — | — | — |
| 44 | 0.032 | 0.01 | 0.01 | 0.001 | 0.001 | 64.99 | 25.17 | 2.97 | 2.5 | 2.47 | 0.70 | 0.99 | — | — | — |
| 45 | 0.020 | 0.01 | 0.01 | 0.001 | 0.001 | 71.87 | 15.60 | 3.01 | 5.2 | 2.48 | 0.65 | 0.99 | — | — | — |
| 46 | 0.043 | 0.02 | 0.01 | 0.001 | 0.002 | 56.01 | 25.15 | 3.00 | 9.1 | 0.91 | 0.57 | 5.07 | — | — | — |
| 47 | 0.043 | 0.003 | 0.01 | 0.001 | 0.002 | 56.11 | 25.18 | 2.97 | 9.7 | 0.89 | 0.091 | 4.92 | — | — | — |
| 48 | 0.033 | 0.08 | 0.01 | 0.001 | 0.002 | 56.05 | 25.21 | 3.05 | 9.1 | 0.39 | 0.046 | 5.89 | — | — | — |
| 49 | 0.033 | 0.08 | 0.01 | 0.001 | 0.002 | 55.32 | 24.95 | 2.99 | 11.1 | 1.16 | 0.061 | 4.21 | — | — | — |
| 50 | 0.040 | 0.06 | 0.01 | 0.001 | 0.002 | 56.66 | 21.97 | 3.01 | 12.1 | 0.85 | 0.076 | 5.10 | — | — | — |
| 51 | 0.043 | 0.04 | 0.59 | 0.001 | 0.002 | 56.06 | 25.26 | 3.01 | 8.7 | 0.87 | 0.091 | 5.20 | — | — | — |
| 52 | 0.039 | 0.27 | 0.59 | 0.002 | 0.002 | 55.68 | 25.14 | 2.98 | 9.2 | 0.85 | 0.090 | 5.11 | — | — | — |
| 53 | 0.054 | 0.04 | 0.01 | 0.002 | 0.001 | 60.22 | 25.20 | 5.94 | 2.4 | 0.88 | 0.071 | 5.07 | — | — | — |
| 54 | 0.038 | 0.07 | 0.01 | 0.001 | 0.002 | 60.61 | 22.26 | 5.93 | 5.1 | 0.76 | 0.077 | 5.08 | — | — | — |
| 55 | 0.040 | 0.05 | 0.01 | 0.001 | 0.001 | 56.11 | 25.68 | 3.10 | 8.7 | 0.86 | 0.091 | 5.21 | — | — | 0.0511 |
| 56 | 0.039 | 0.06 | 0.01 | 0.001 | 0.001 | 56.03 | 25.32 | 3.05 | 9.2 | 0.89 | 0.080 | 5.16 | — | 0.068 | — |
| 57 | 0.041 | 0.07 | 0.01 | 0.001 | 0.002 | 56.15 | 25.43 | 2.98 | 9.0 | 0.85 | 0.083 | 5.22 | 0.075 | — | — |
| 58 | 0.038 | 0.05 | 0.01 | 0.001 | 0.001 | 56.06 | 25.16 | 3.04 | 9.3 | 0.87 | 0.078 | 5.18 | 0.036 | 0.048 | — |

TABLE 3-1

Influence of heat treatment and working conditions on stress corrosion cracking resistance. Test pieces regarding alloy 9 were used. Working process was in the order of hot working, solid solution treatment, cold working and aging treatment.

| Test No. | Hot Working | Solid Solution Treatment | Cold Working | Aging Treatment | Resistance to Stress Corrosion Cracking |
|---|---|---|---|---|---|
| 1 | 10% Draft | Air Cooling (1150° C. × 1 h) | None | Air Cooling (715° C. × 16 h) | X |
| 2* | | | | Air Cooling (816° C. × 24 h) + Air Cooling (704° C. × 20 h) | X |
| 3 | 20% Draft | Air Cooling (1150° C. × 1 h) | None | Air Cooling (715° C. × 1 h) | O |
| 4 | | | | Air Cooling (715° C. × 16 h) | O |
| 5 | | | | Air Cooling (715° C. × 150 h) | O |
| 6 | | | | Air Cooling (816° C. × 24 h) + Air Cooling (704° C. × 20 h) | O |
| 7 | | | | Furnace Cooling (732° C. × 8 h) + Air Cooling (621° C. × 8 h) | O |
| 8 | 40% Draft | Air Cooling (1150° C. × 1 h) | None | Air Cooling (715° C. × 16 h) | O |
| 9 | | | | Air Cooling (816° C. × 24 h) + Air Cooling (704° C. × 2 h) | O |
| 10 | | Air Cooling (1080° C. × 1 h) | None | Air Cooling (715° C. × 16 h) | O |
| 11 | | | | Air Cooling (816° C. × 24 h) + Air Cooling (704° C. × 20 h) | O |
| 12 | | Air Cooling (980° C. × 1 h) | None | Air Cooling (715° C. × 16 h) | O |
| 13 | | | | Air Cooling (816° C. × 24 h) + Air Cooling (704° C. × 20 h) | O |
| 14 | 10% Draft | Water Cooling (980° C. × 1 h) | 10% | Air Cooling (715° C. × 16 h) | O |
| 15 | | | 20% | Air Cooling (715° C. × 16 h) | O |
| 16 | | | 30% | Air Cooling (715° C. × 16 h) | O |
| 17 | 10% Draft | Water Cooling (1080° C. × 1 h) | 10% | Air Cooling (715° C. × 16 h) | O |
| 18 | | | 20% | Air Cooling (715° C. × 16 h) | O |
| 19 | | | 30% | Air Cooling (715° C. × 1 h) | O |
| 20 | | | | Air Cooling (715° C. × 16 h) | O |
| 21 | | | | Air Cooling (715° C. × 150 h) | O |
| 22 | | | | Furnace Cooling (732° C. × 8 h) + Air Cooling (621° C. × 8 h) | O |
| 23 | | Water Cooling (1150° C. × 1 h) | 10% | Air Cooling (715° C. × 16 h) | O |
| 24 | | | 20% | Air Cooling (715° C. × 16 h) | O |
| 25 | | | 30% | Air Cooling (715° C. × 16 h) | O |

X: Cracked
O: Not cracked

TABLE 3-2

Influence of heat treatment and working conditions on stress corrosion cracking resistance. Test pieces regarding alloy 9 were used. Working process was in the order of hot working, solid solution treatment, cold working and aging treatment.

| Test No. | Hot Working | Solid Solution Treatment | Cold Working | Aging Treatment | Resistance to Stress Corrosion Cracking |
|---|---|---|---|---|---|
| 1 | 10% Draft | Air Cooling (1150° C. × 1 h) | None | Air Cooling (700° C. × 18 h) | X |
| 2 | | | | Furnace Cooling (760° C. × 10 h) + Air Cooling (643° C. × 8 h) | X |
| 3 | 20% Draft | Air Cooling (1150° C. × 1 h) | None | Air Cooling (700° C. × 1 h) | O |
| 4 | | | | Air Cooling (700° C. × 18 h) | O |
| 5 | | | | Air Cooling (700° C. × 150 h) | O |
| 6 | | | | Furnace Cooling (760° C. × 10 h) + Air Cooling (643° C. × 8 h) | O |
| 7 | | | | Furnace Cooling (718° C. × 8 h) + Air Cooling (621° C. × 8 h) | O |
| 8 | 40% Draft | Air Cooling (1150° C. × 1 h) | None | Air Cooling (700° C. × 18 h) | O |
| 9 | | | | Furnace Cooling (760° C. × 10 h) + Air Cooling (643° C. × 8 h) | O |
| 10 | | Air Cooling | None | Air Cooling (700° C. × 18 h) | O |

TABLE 3-2-continued

Influence of heat treatment and working conditions on stress corrosion cracking resistance. Test pieces regarding alloy 9 were used. Working process was in the order of hot working, solid solution treatment, cold working and aging treatment.

| Test No. | Hot Working | Solid Solution Treatment | Cold Working | Aging Treatment | Resistance to Stress Corrosion Cracking |
|---|---|---|---|---|---|
| | | (1080° C. × 1 h) | | | |
| 11 | | | | Furnace Cooling (760° C. × 10 h) + Air Cooling (643° C. × 8 h) | O |
| 12 | | Air Cooling (980° C. × 1 h) | None | Air Cooling (700° C. × 18 h) | O |
| 13 | | | | Furnace Cooling (760° C. × 10 h) + Air Cooling (643° C. × 8 h) | O |
| 14 | 10% Draft | Water Cooling (980° C. × 1 h) | 10% | Air Cooling (700° C. × 18 h) | O |
| 15 | | | 20% | Air Cooling (700° C. × 18 h) | O |
| 16 | | | 30% | Air Cooling (700° C. × 18 h) | O |
| 17 | 10% Draft | Water Cooling (1080° C. × 1 h) | 10% | Air Cooling (700° C. × 18 h) | O |
| 18 | | | 20% | Air Cooling (700° C. × 18 h) | O |
| 19 | | | 30% | Air Cooling (700° C. × 1 h) | O |
| 20 | | | | Air Cooling (700° C. × 18 h) | O |
| 21 | | | | Air Cooling (700° C. × 150 h) | O |
| 22 | | | | Furnace Cooling (718° C. × 8 h) + Air Cooling (621° C. × 8 h) | O |
| 23 | | Water Cooling (1150° C. × 1 h) | 10% | Air Cooling (700° C. × 18 h) | O |
| 24 | | | 20% | Air Cooling (700° C. × 18 h) | O |
| 25 | | | 30% | Air Cooling (700° C. × 18 h) | O |

X: Cracked
O: Not cracked

TABLE 4

In the respective drawings, white symbols indicate "not cracked" and black symbols indicate "cracked".

| Drawing | Symbol | Heat Treatment |
|---|---|---|
| FIG. 2 (a) | ○ | Air Cooling (Solid Sol. Treatment Temp. × 1 h) + Air Cooling (715° C. × 16 h) |
| | Δ | Water Cooling (Solid Sol. Treatment Temp. × 1 h) + Air Cooling (715° C. × 16 h |
| FIG. 2 (b) | ○ | Water Cooling (Solid Sol. Treatment Temp. × 1 h) + Furnace Cooling (718° C. × 8 h) + Air Cooling (621° C. × 8 h) |
| | Δ | Air Cooling (Solid Sol. Treatment Temp. × 1 h) + Air Cooling (700° C. × 18 h) |
| FIG. 3 | ○ | Air Cooling (Solid Sol. Treatment Temp. × 1 h) + Air Cooling (816° C. × 24 h) + Air Cooling (704° C. × 20 h) |
| | Δ | Air Cooling (Solid Sol. Treatment Temp. × 1 h) + Air Cooling (715° C. × 16 h) |
| FIG. 4 | ○ | Air Cooling (Solid Sol. Treatment Temp. × 1 h) + Furnace Cooling (718° C. × 8 h) + Air Cooling (621° C. × 8 h) |
| | Δ | Air Cooling (Solid Sol. Treatment Temp. × 1 h) + Air Cooling (700° C. × 18 h) |
| FIG. 5 | ○□Δ | Air Cooling (Solid Sol. Treatment Temp. × 1 h) + Furnace Cooling (760° C. × 10 h) + Air Cooling (643° C. × 8 h) |
| FIG. 6 | ○ | Air Cooling (Solid Sol. Treatment Temp. × 1 h) + Air Cooling (715° C. × 16 h) |
| FIG. 7 | ○ | Air Cooling (Solid Sol. Treatment Temp. × 1 h) + Air Cooling (715° C. × 16 h) |
| FIG. 9 | ○ | Air Cooling (982° C. × 1 h) + Air Cooling (816° C. × 24 h) + Air Cooling (704° C. × 20 h) |
| FIG. 10 | ◎ | Air Cooling (982° C. × 1 h) + Air Cooling (715° C. × 16 h) |
| | Δ | Air Cooling (1080° C. × 1 h) + Air Cooling (715° C. × 16 h) |
| | • | Water Cooling (1080° C. × 1 h) + Air Cooling (715° C. × 16 h) |
| | □ | Air Cooling (1150° C. × 1 h) + Air Cooling (715° C. × 16 h) |

TABLE 5

Exemplary metallic construction of alloy regarding the present invention.

| Alloy No. | Heat Treatment Conditions: Solid Solution Treatment | Heat Treatment Conditions: Aging Treatment | Mother Phase | Precipitate: Grain Boundary | Precipitate: Grain Interior |
|---|---|---|---|---|---|
| 9 | Air Cooling (980° C. × 1 h) | Air Cooling (715° C. × 16 h) | γ | $M_{23}C_6$ | γ' and γ'' |
| " | Air Cooling (1080° C. × 1 h) | Air Cooling (715° C. × 16 h) | γ | $M_{23}C_6$ | γ' and γ'' |
| " | Air Cooling (1080° C. × 1 h) | Air Cooling (760° C. × 16 h) | γ | $M_{23}C_6$ | γ' and γ'' |
| " | Air Cooling (1150° C. × 1 h) | Air Cooling (715° C. × 16 h) | γ | $M_{23}C_6$ | γ' and γ'' |

TABLE 6

Influence of rare element and heat treatment conditions on stress corrosion resistance of test piece.

| Alloy No. | Chemical Composition | | | | | | | | | | | |
|---|---|---|---|---|---|---|---|---|---|---|---|---|
| | C | Si | Ni | Cr | Fe | Ti | Al | Nb | Hf | Y | Ca | Mg |
| 15 | 0.039 | 0.032 | 63.0 | 25.50 | 7.01 | 2.54 | 0.73 | 0.96 | — | — | — | 0.050 |
| 16 | 0.040 | 0.031 | 63.0 | 25.50 | 7.06 | 2.63 | 0.68 | 1.01 | — | 0.070 | — | — |
| 17 | 0.041 | 0.025 | 62.9 | 25.60 | 7.05 | 2.60 | 0.72 | 0.99 | 0.065 | — | — | — |
| 18 | 0.041 | 0.030 | 62.8 | 25.80 | 6.97 | 2.56 | 0.67 | 1.02 | 0.032 | 0.041 | — | 0.01 |
| 20 | 0.041 | 0.030 | 63.1 | 25.65 | 6.95 | 2.56 | 0.67 | 1.00 | — | — | 0.001 | — |
| 9 | 0.032 | 0.031 | 64.1 | 24.61 | 6.94 | 2.62 | 0.71 | 0.92 | — | — | — | — |

| Alloy No. | Solid Solution Treatment | Aging Treatment | Cracking Test Result |
|---|---|---|---|
| 15 | Air Cooling (1000° C. × 1 h) | Air Cooling (816° C. × 24 h) + Air Cooling (704° C. × 20 h) | Not Cracked |
| 16 | " | Air Cooling (816° C. × 24 h) + Air Cooling (704° C. × 20 h) | " |
| 17 | " | Air Cooling (816° C. × 24 h) + Air Cooling (704° C. × 20 h) | " |
| 18 | " | Air Cooling (816° C. × 24 h) + Air Cooling (704° C. × 20 h) | " |
| 20 | " | Air Cooling (816° C. × 24 h) + Air Cooling (704° C. × 20 h) | " |
| 9 | " | Air Cooling (816° C. × 24 h) + Air Cooling (704° C. × 20 h) | " |

As described above, the present invention permits obtaining the Ni-based alloy which has the satisfactory mechanical strength and stress corrosion cracking resistance simultaneosuly, and therefore the Ni-based alloy according to the present invention can be utilized extremely safely for a period of its prolonged life as fastening members, spring parts and the like, in addition to structural parts in the light-water reactor.

What is claimed is:

1. A high-strength Ni-based alloy excellent in resistance to stress corrosion cracking in high-temperature high-pressure pure water, characterized by consisting essentially of, in terms of weight ratio, 0.08% or less of C, 0.15% or less of Si, 0.1 to 1% of Mn, 15% or less of Fe, 20 to 30% of Cr, 0.76–35% of Ti, 2% or less of Al, 7% or less of Nb and the balance of Ni; having at least one of a $\gamma'$ phase and a $\gamma''$ phase in a Y base; and semicontinuously predominantly precipitating $M_{23}C_6$ in grain boundaries.

2. A high-strength Ni-based alloy according to claim 1 wherein 10% by weight or less of Mo is additionally contained in said alloy to be treated.

3. A high-strength Ni-based alloy according to claim 1 wherein 0.1% by weight or less of at least one of a rare earth element, Mg and Ca is contained in said alloy to be treated.

4. A high-strength Ni-based alloy according to claim 1 wherein 10% by weight or less of Mo and 0.1% by weight or less of at least one of a rare earth element, Mg and Ca are contained in said alloy.

5. A method for preparing a high-strength Ni-based alloy excellent in resistance to stress corrosion cracking in high-temperature, high-pressure pure water, principally characterized by heating and maintaining, at 980 to 1,200° C., said alloy consisting essentially of, in terms of weight ratio, 0.08% or less of C, 0.15% or less of Si, 0.1 to 1% of Mn, 15% or less of Fe, 20 to 30% of Cr, 0.76–3.5% of Ti, 2% or less of Al, 7% or less of Nb and the balance of Ni; cooling said alloy; and subjecting said alloy once or more to an aging treatment of additionally heating and maintaining it at 550° to 850° C. whereby said alloy has at least one of a $\gamma'$ phase and a $\gamma''$ phase in a $\gamma$ base and semicontinuously predominantly precipitating $M_{23}C_6$ in grain boundaries.

6. A method for preparing a high-strength Ni-based alloy according to claim 5 wherein 10% by weight or less of Mo is additionally contained in said alloy to be treated.

7. A method for preparing a high-strength Ni-based alloy according to claim 5 wherein 0.1% by weight or less of at least one of a rare earth element, Mg and Ca is additionally contained in said alloy to be treated.

8. A method for preparing a high-strength Ni-based alloy according to claim 5 wherein 10% by weight or less of Mo and 0.1% by weight or less of at least one of a rare earth element, Mg and Ca are additionally contained in said alloy to be treated.

9. A method for preparing a high-strength Ni-based alloy according to claim 5 wherein a duration of said first heating and maintaining step is within the range of 5 minutes to 5 hours, a cooling rate in said cooling step is an air cooling rate or more, and a duration of said aging treatment is 1 to 150 hours.

10. A method for preparing a high-strength Ni-based alloy excellent in resistance to stress corrosion cracking in high-temperature high-pressure pure water, principally characterized by heating, and maintaining at 980 to 1,200° C., said alloy consisting essentially of, in terms of weight ratio, 0.08% or less of C, 0.15% or less of Si, 0.1 to 1% of Mn, 15% or less of Fe, 20 to 30% of Cr, 0.76%–3.5% of Ti, 2% or less of Al, 7% or less of Nb and the balance of Ni; cooling said alloy; and subjecting said alloy once or more to an aging treatment of additionally heating and maintaining it at 550 to 850° C. whereby said alloy has at least one of a $\gamma'$ and a $\gamma''$ phase dispersed in a $\gamma$ base and semicontinuously predominantly precipitating $M_{23}C_6$ in grain boundaries.

11. A method for preparing a high-strength Ni-based alloy excellent in resistance to stress corrosion cracking in high-temperature high-pressure pure water, principaly characterized by heating and maintaining, at 980 to 1,200° C., said alloy consisting essentially of, in terms of weight ratio, 0.08% or less of C, 0.15% or less of Si, 0.1 to 1% of Mn, 15% or less of Fe, 20 to 30% of Cr, 0.75–3.5% of Ti, 2% or less of Al, 7% or less of Nb and the balance of Ni; cooling said alloy; subjecting said alloy to a cold working at a 10% or more reduction of area; and subjecting said alloy once or more to an aging treatment of additionally heating and maintaining it at 550° to 850° C. whereby said alloy has at least one of a $\gamma'$ phase and a $\gamma''$ dispersed in a $\gamma$ base and semicontinuously predominantly precipitating $M_{23}C_6$ in grain boundaries.

12. A method for preparing a high-strength Ni-based alloy according to claim 10 wherein 0.1% by weight or less of at least one of a rare earth element, Mg and Ca is additionally contained in said alloy to be treated.

13. A method for preparing a high-strength Ni-based alloy according to claim 10 wherein 10% by weight or less of Mo and 0.1% by weight or less of at least one of a rare earth element, Mg and Ca are additionally contained in said alloy to be treated.

14. A method for preparing a high-strength Ni-based alloy according to claim 10 wherein a duration of said first heating and maintaining step is within the range of 5 minutes to 5 hours, a cooling rate in said cooling step is an air cooling rate or more, and a duration of said aging treatment is 1 to 150 hours.

15. A method for preparing a high-strength Ni-based alloy excellent in resistance to stress corrosion cracking in high-temperature high-pressure pure water, principally characterized by subjecting, to a hot working at 850 to 1,250° C. at a draft percentage of 20% or more, said alloy consisting essentially of, in terms of weight ratio, 0.08% or less of C, 0.15% or less of Si, 0.1 to 1% of Mn, 15% or less of Fe, 20 to 30% of Cr, 0.76–3.5% of Ti, 2% or less of Al, 7% or less of Nb and the balance of Ni; heating and maintaining said alloy at 980° to 1,200° C.; cooling said alloy; and subjecting said alloy once or more to an aging treatment of additionally heating and maintaining it at 550° to 850° C. whereby said alloy has at least one of a $\gamma'$ phase and $\gamma''$ phase in a base and semicontinuously predominantly precipitating $M_{23}C_6$ in grain boundaries.

16. A method for preparing a high-strength Ni-based alloy according to claim 15 wherein 10% by weight or less of Mo is additionally contained in said alloy to be treated.

17. A method for preparing a high-strength Ni-based alloy according to claim 15 wherein 0.1% by weight or less of at least one of a rare earth element, Mg and Ca is additionally contained in said alloy to be treated.

18. A method for preparing a high-strength Ni-based alloy according to claim 15 wherein 10% by weight or less of Mo and 0.1% by weight or less of at least one of a rare earth element, Mg and Ca are additionally contained in said alloy to be treated.

19. A method for preparing a high-strength Ni-based alloy according to claim 15 wherein a duration of said heating and maintaining step at 980° to 1,200° C. is within the range of 5 minutes to 5 hours, a cooling rate in said cooling step is an air cooling rate or more, and a duration of said aging treatment is 1 to 150 hours.

* * * * *